United States Patent [19]

Kobayashi et al.

[11] Patent Number: 4,809,966

[45] Date of Patent: Mar. 7, 1989

[54] BILL VALIDATOR HAVING CONSTANT SPRING BILL ACCUMULATION MECHANISM

[75] Inventors: Osamu Kobayashi, Tsurugashima; Hiroshi Hayashi, Sakado, both of Japan

[73] Assignee: Kabushiki Kaisha Nippon Coinco, Tokyo, Japan

[21] Appl. No.: 25,401

[22] Filed: Mar. 13, 1987

[30] Foreign Application Priority Data

Mar. 17, 1986 [JP] Japan ..... 61-57161

[51] Int. Cl.[4] ..... B65H 31/06; B65H 29/46

[52] U.S. Cl. ..... 271/181; 271/214; 194/206

[58] Field of Search ..... 194/206, 207; 271/177, 271/180, 181, 213, 214, 215; 209/534; 235/379; 902/9, 13, 17

[56] References Cited

U.S. PATENT DOCUMENTS

| | | | |
|---|---|---|---|
| 1,166,017 | 12/1915 | Smyth | 271/181 |
| 2,659,907 | 11/1953 | Kramer | 271/181 X |
| 3,148,879 | 9/1964 | Kistner | 271/181 X |
| 3,655,186 | 4/1972 | Bayha | 271/180 |
| 3,811,549 | 5/1974 | Preisig | 271/213 X |
| 4,474,366 | 10/1984 | Reider | 271/181 |

FOREIGN PATENT DOCUMENTS

| | | | |
|---|---|---|---|
| 230648 | 2/1911 | Fed. Rep. of Germany | 271/181 |
| 0027700 | 3/1977 | Japan | 194/206 |

OTHER PUBLICATIONS

"Stacker-Reader Sorter", F. W. Doolittle et al., IBM Technical Disclosure Bulletin, vol. 13, No. 10, Mar. 1971, pp. 3109-3110.

*Primary Examiner*—Kevin P. Shaver
*Assistant Examiner*—Edward S. Ammeen
*Attorney, Agent, or Firm*—Spensley Horn Jubas & Lubitz

[57] ABSTRACT

This bill validator accumulates bills between a pair of spaced parallel stationary members forming an entrance of a bill accumlating box and a bill compressing plate provided in the bill accumulating box. A push member is disposed in the vicinity of the entrance of the accumulating box. This push member is actuated by a reciprocating mechanism to push a bill positioned at the entrance into the accumulating box and thereby add this bill to a stack of accumulated bills. Constant springs are provided in association with the bill compressing plate. These constant springs enclose a bill accumulating space in the accumulating box with their winding shafts being pivotably connected on the accumulating box and their taken out ends being fixedly secured to the bill compressing plate. The constant springs urge the bill compressing plate to the entrance of the accumulating box with a constant pressing force. Since the pressing force of the constant springs can be made small regardless of a maximum possible number of bills to be accumulated, the driving force required for reciprocating the push member against this spring force can be made small.

2 Claims, 4 Drawing Sheets

BILL VALIDATOR HAVING CONSTANT SPRING BILL ACCUMULATION MECHANISM

BACKGROUND OF THE INVENTION

This invention relates to improvement in a bill validator used for validating bills, gift coupons and the like (hereinafter referred to as "a bill" ) in a vending machine or the like machine handling money, coupons or the like.

Various bill validators have been proposed in the past and these bill validators have a general structure according to which, as shown in FIG. 6, a bill forwarded by bill forwarding means is pressed in a direction normal to the surface of the bill to store it between a bill support 50 and a bill stopping rib (or channel member) 51 (e.g., Japanese Preliminary Patent Publication No. 60-77287 and corresponding U.S. patent application Ser. No. 656,585 now U.S. Pat. No. 4,678,072).

In such prior art bill validators, the bill support 50 is always pressed against the rib 51 by force of a spring 52. As the number of received bills increases, therefore, the counterpressure of the spring increases and a bill pressing device 53 requires a pressing force which will overcome the counterpressure of the spring. On the other hand, the force of the spring 52 must be such that it will exercise a sufficient pressing force even when there is no bill to be received, i.e., when the spring 52 is stretched to the extremity. For this reason, the counterpressure of the spring 52 is of a relatively large value when the number of bills received is large. This necessitates provision of a motor section (motor M2) of the bill pressing device 53 having a large torque equivalent to the counterpressure of the spring which is encountered at a maximum number of received bills. Further, if it is desired to increase the maximum number of bills to be received, it is not sufficient to increase the capacity of a bill box but a motor of a larger size must be employed as the motor M2 for increasing the required torque. Besides, since in this type of device the bill is moved in sliding movement along the inner surface (particularly the bottom surface) of the bill box every time the bill is received, the bill pressing device 53 is required to have a pressing force overcoming the friction caused by this sliding movement in addition to the pressing force overcoming the force of the spring. This friction increases as the number of received bills increases so that the pressing force of the bill pressing member 53 must increase. For these reasons, the prior art bill validator has the disadvantage that the motor section and structure for pressing bills tend to become undesirably large. Moreover, since there is limitation on the power, mere increase in the capacity of the bill box is not sufficient for receiving more bills. Furthermore, the friction due to the sliding movement of the bill sometimes damages the bill (particularly in the lower end portion thereof). This sometimes poses a serious problem because the peripheral portion of the bill becomes rigid due to friction caused by frequent sliding movement of the bill with a result that the bill becomes unusable in circulation.

SUMMARY OF THE INVENTION

It is, therefore, an object of the invention to provide a bill validator which requires a relatively small force of a spring for pressing bills regardless of the number of bills received whereby torque of a motor section of a bill pressing device for pressing bills against the force of the spring can stay at a relatively small value.

It is another object of the invention to provide a bill validator capable of preventing damage to the peripheral portion of a received bill.

For achieving these objects, the bill validator according to the invention comprises an accumulating box for accumulating bills, bill conveying means for conveying bills to be accumulated to an entrance of said bill accumulating box, reciprocating means disposed in the vicinity of said entrance of said accumulating box and comprising a push member for pushing a bill positioned at said entrance into said accumulating box and a mechanism for reciprocating said push member, a pair of spaced parallel stationary members forming said entrance of said accumulating box, there being a space between said pair of spaced parallel stationary members which is somewhat narrower than the width of the bill, a bill compressing plate, provided in said accumulating box, having breadth corresponding to the size of the bill and being movable in a translational motion in a normal direction to the surface of said plate, and constant springs enclosing a bill accumulating space in said accumulating box with winding shafts thereof being pivotably connected to said accumulating box and takeout end thereof being fixedly secured to said bill compressing plate, and urging said bill compressing plate to said entrance of said accumulating box with a constant pressing force, a plurality of bills being accumulated between said parallel stationary members of said entrance and said bill compressing plate in said accumulating box.

As a bill is located at the entrance of the accumulating box, the push member is actuated to push the bill into the accumulating box against the pressing force acting in the opposite direction of the bill compressing plate. The pushed bill passes between the parallel stationary members in a flexed form and is led to the bill accumulating space in the bill accumulating box. As the push member is withdrawn thereafter, the bill is held between the bill compressing plate and the parallel stationary members. In this case, the pressing force exercised by the bill compressing plate is maintained constant by the constant springs regardless of the number of received bills. By supporting the periphery of the bill by taken out surfaces of the constant springs, the periphery of the bill is always supported in the same location of the constant springs because the constant springs are pulled out and pulled in association with the movement of the bill compressing plate so that the periphery of the bill does not slide along any member of the device.

According to this invention, therefore, since the bill compressing plate is urged towards the bill accumulating box by the constant springs, the pressing force of the constant springs has only to be a relatively small one satisfying a minimum requirement with a result that torque of a motor section of the reciprocating means for driving the push member can be of a relatively small value. In correspondence to the relatively small pressing force of the constant springs, the push member has only to push the bill with a relatively small constant pressing force regardless of the number of bills accumulated in the accumulating box so that a bill accumulating box of a large capacity can be used with reciprocating means of a small driving force and, further, change in the bill accumulating capacity (i.e., changing a large capacity to a small one or vice versa) can be made simply by changing the size of the bill accumulating box without changing the design of the driving force of the reciprocating means.

Furthermore, by supporting the received bill on the taken out surface of the constant springs, the received bill is moved with the constant springs and no sliding movement occurs between the bill and the taken out surfaces or any other surface in the accumulating box so that the likelihood of damage in the peripheral portion of the bill due to sliding movement of the bill can be eliminated.

BRIEF DESCRIPTION OF THE DRAWINGS

In the accompanying drawings.

DESCRIPTION OF PREFERRED EMBODIMENTS

Figure 1:
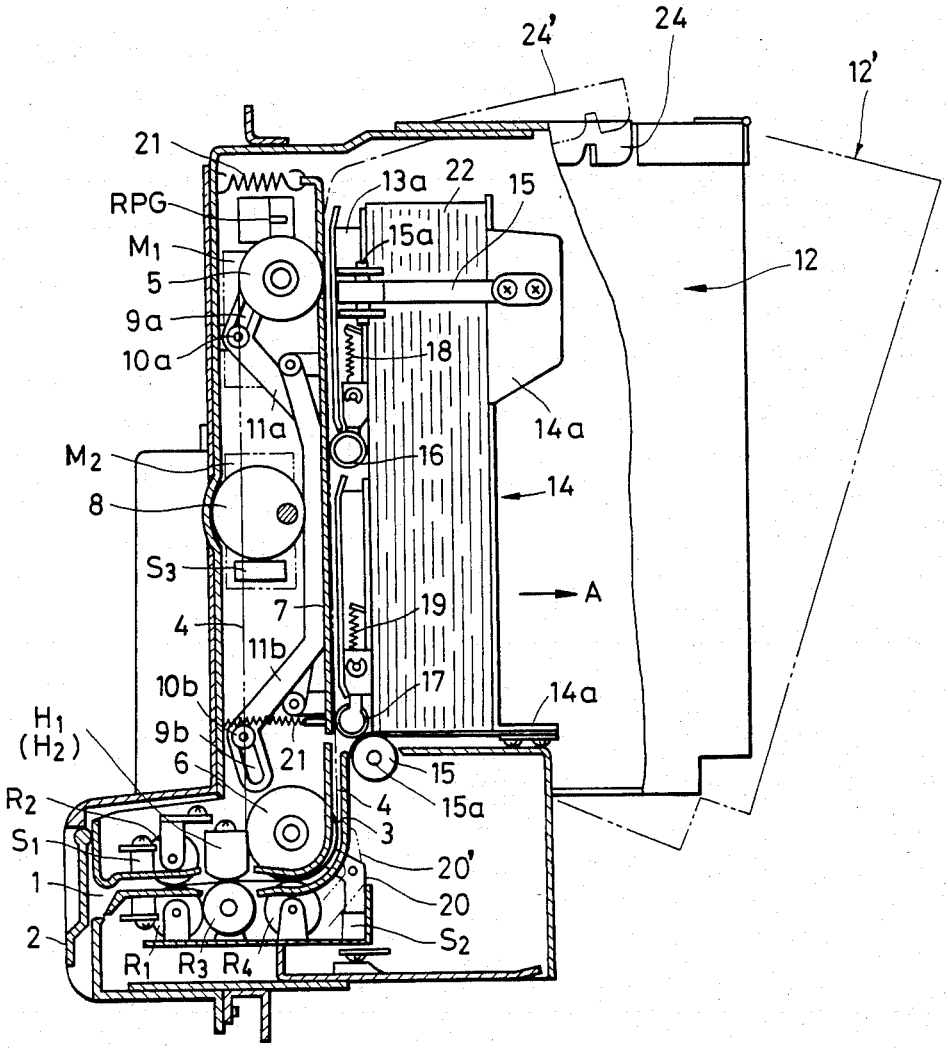
FIG. 1 is a vertical sectional view showing an embodiment of the invention.

FIG. 1 shows an embodiment of a bill validator to which this invention has been applied. The main body of this bill validator consists of a vertical long casing. A bill insertion slit 1 is formed in the lower portion of a front surface (left side surface as viewed in the figure). A bill can be inserted in the insertion slit 1 by lifting a cover 2. In the casing, there is provided an L-shaped bill conveying passage 3 communicating with the insertion slit 1 and conveying the bill in the longitudinal direction. In the short straight portion of this L-shaped bill conveying passage 3 nearer to insertion slit 1, there are provided magnetic heads H1 and H2 for discriminating a true bill from a false one. The magnetic heads H1 and H2 constitute a pair across the center line and detect magnetic ingredient contained in the printing ink. In the vicinity of the insertion slit 1, there is provided a bill sensor S1 for detecting the insertion of the bill.

In the bill conveying passage 3 are provided a pair of bill conveying belts 4, a conveying motor M1 for driving these belts 4 and pulleys 5 and 6 transmitting rotation of this motor M1 to the belts 4. The rotation of the motor M1 is transmitted to the upper pair of pulleys 5 and the lower pair of pulleys 6 are thereby driven. The lower pulleys 6 are provided at the corner of the L-shape and the upper pulleys 5 are provided at the upper end of the L-shape. The belts 4 extend over the longer straight portion from the corner of the L-shaped conveying passage 3 and the driving force is exercised to the bill in this section. There is also provided a rotation pulse generator RPG which generates an electric pulse signal in synchronism with the rotational position of the conveying motor M1. This pulse signal is used for producing bill position address data when discrimination of a true bill from a false one is performed on the basis of outputs of the magnetic heads H1 and H2. The magnetism distribution on the surface of a bill exhibits a specific pattern in correspondence to address positions on the bill and the discrimination of bills for each denomination can be made in accordance with this pattern. Reference characters R1, R2, R3 and R4 respectively denote driven rollers.

A reciprocating device for performing accumulation of bills is provided in the longer straight portion of the L-shaped conveying passage 3. This reciprocating device comprises a push plate 7 for pushing a bill conveyed on the conveying belts 4 in the direction of the surface of the bill and a mechanism for reciprocating this push plate 7 in accordance with rotation of a motor M2. There are provided a pair of eccentric cams 8 mounted eccentrically on the rotation shaft of the motor M2 and a pair of link rods 11*a* and 11*b* which are pivotally connected in one end portions thereof to the push plate 7 and fixedly connected in the other end portions thereof to pins 10*a* and 10*b* through slots 9*a* and 9*b*. As the motor M2 is rotated, the cams 8 are actuated to push the link rods 11*a* and 11*b* and the push plate 7 thereby is moved in translational movement in the direction of the surface of the plate. The push plate 7 is constantly urged to the cams 8 by the force of a spring 21 so that the push plate 7 is moved in reciprocating motion in association with the eccentric movement of the cams 8.

Figure 2:
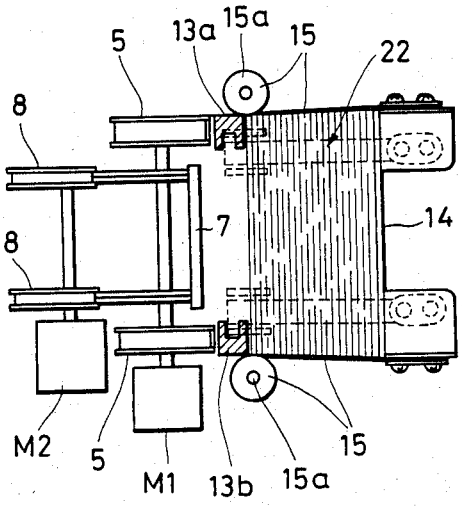
FIG. 2 is a cross sectional view of an essential portion of the same embodiment.
Figure 3:
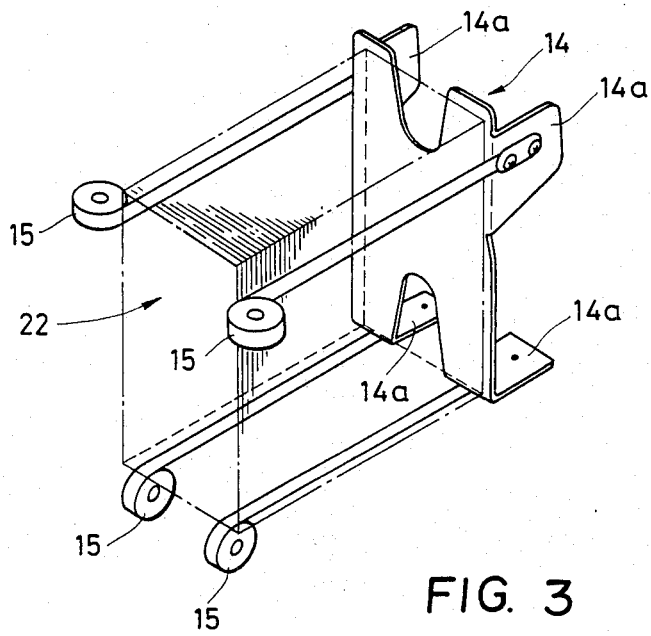
FIG. 3 is a perspective view of an essential portion of a bill accumulating box in the same embodiment.

An accumulating box 12 for accumulating bills pushed by the reciprocating device is provided in the other straight portion of the L-shaped conveying passage 3. As shown in FIG. 2, the accumulating box 12 has its entrance formed by a vertically disposed pair of parallel elongated bill support channel members 13*a* and 13*b* which are spaced from each other with a space therebetween being somewhat narrower than the width of the bill. A bill compressing plate 14 is provided in the accumulating box 12 in parallel to the channel members 13*a* and 13*b* and the push plate 7. This bill compressing plate 14 has breadth corresponding to the size of the bill. While the channel members 13*a* and 13*b* are stationary, the bill compressing plate 14 is movable in a translational motion in a normal direction to the surface of the plate. At predetermined locations nearer to the channel members 13*a* and 13*b* in the bill accumulating space (i.e., the inner surface of the box 12), e.g., two locations on the left and right sides and two locations in the lower portion, there are rotatably mounted winding shafts 15*a* of constant springs 15. The takeout ends of the respective constant springs 15 are fixedly secured to connecting portions 14*a* provided in the left and right sides and the lower surface of the bill compressing plate 14 (FIG. 3). Owing to the action of the constant springs 15, the bill compressing plate 14 is always urged in the direction of the channel members 13*a* and 13*b* with a constant pressing force wherever the bill compressing plate 14 may be positioned. The taken out surfaces of the constant springs 15 are in contact with the periphery of the bill 22 and thereby supports the bill 22. The periphery of the bill 22 is not in contact with any other member than the constant springs 15.

A part nearer to the conveying passage 3 of each of the channel members 13*a* and 13*b* is cut off and the driven rollers 16 and 17 are provided in the recesses. These rollers 16 and 17 are always urged towards the belt 4 by the force of the springs 18 and 19 so that these rollers 16 and 17 are rotated while holding the bill conveyed with the moving belts 4 between them and the belts 4.

In a standby mode, the reciprocating device is in a state as shown in FIG. 1. In this state, the push plate 7 is in the furthest position from the accumulating box 12 and the space between this push plate 7 and the channel members 13*a* and 13*b* forms a passage for the bill.

A lever 20 is disposed at the corner of the L-shaped conveying passage 3 with an end portion thereof projecting in the passage 3. The lever 20 is so constructed that it is pushed by a bill advancing in the forward direction (i.e., bill receiving direction) to withdraw automatically out of the passage but it functions as a stop against a bill moving in the reverse direction. A sensor S2 is provided for detecting the motion of this lever 20. This sensor S2 is turned on when the lever 20 has been withdrawn out of the passage as shown by a chain-and-dot line 20' during advancing of the bill and it is turned off when the lever 20 has returned to the passage.

Upon detection of insertion of a bill by the sensor S1, the conveying motor M2 is rotated forwardly to convey the inserted bill forwardly along the conveying passage 3. In the conveying process, validation of the bill is made on the basis of the outputs of the magnetic heads H1 and H2. If the bill is a false one, the motor M1 is reversely rotated to immediately return the bill to the depositor. If the bill has finally been judged to be a true bill and the rear end of the forwardly conveyed bill has passed by the lever 20 causing the sensor S2 to turn off from the on-state, a true bill signal is supplied to an outside device utilizing the bill validator and is used for counting the number of bills deposited. Upon lapse of a predetermined period of time, the forward rotation of the motor M1 is stopped so that the inserted bill is stopped at a position in front of the push plate 7. Then the motor M2 is forwardly rotated to perform the bill accumulating operation for accumulating bills in the bill accumulating box 12. A carrier switch S3 is mounted on the rotation shaft of the motor M2 so as to rotate the motor M2 by one rotation during the bill accumulating operation. In response to one rotation of the motor M2, the eccentric cams 8 are rotated by one rotation and the push plate 7 thereby is moved in one reciprocating motion.

Figure 4:
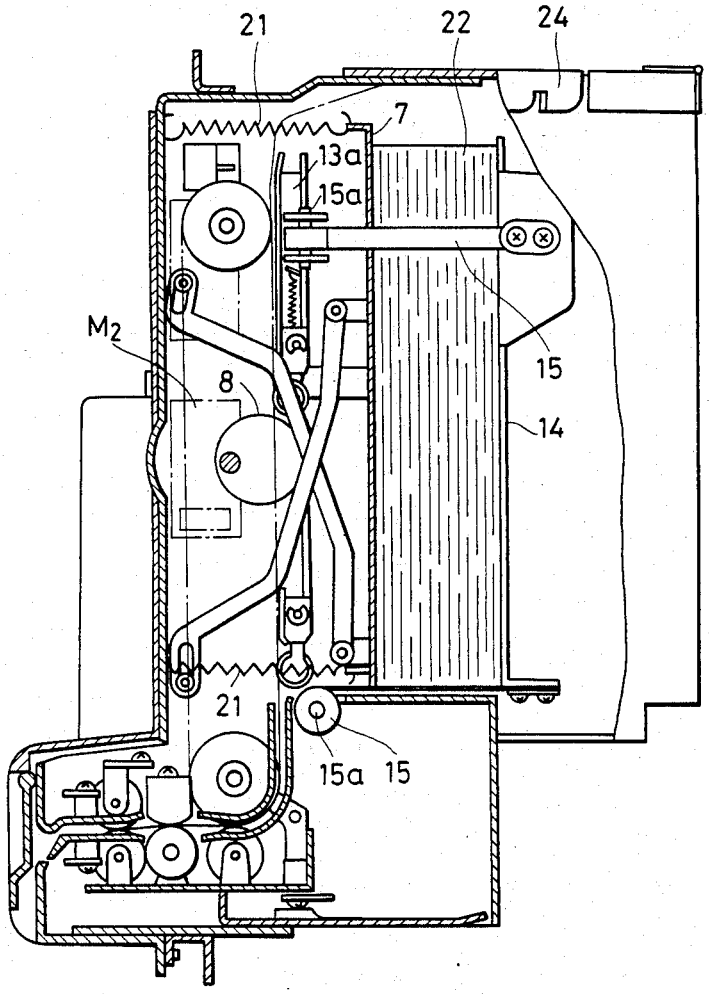
FIG. 4 is a vertical sectional view showing a state where the reciprocating device has moved in a translational motion by a maximum distance in the embodiment of FIG. 1.

When the push plate 7 approaches the bill compressing plate 14, the push plate 7 passes between the channel members 13*a* and 13*b* while pushing the bill in the conveying passage (at this time, the bill passes through the channel members 13*a* and 13*b* in a flexed shape) and moves the bill compressing plate 14 in the direction of arrow A against the force of the constant springs 15 while pressing the bill to the bill compressing plate 14. There is produced a space between the channel members 13*a* and 13*b* and the bill compressing plate 14 and the pushed bill enters this space. FIG. 4 shows a state where the reciprocating member has moved in translational motion by a maximum distance. In this state, the eccentric cams 8 have rotated by half rotation. By the remaining half rotation of the eccentric cams 8, the push plate 7 returns in the direction of arrow A and the bill compressing plate 14 is pushed towards the channel members 13*a* and 13*b* by the force of the constant springs 15. Upon abutting engagement of both sides of the bill with the channel members 13*a* and 13*b*, the movement of the bill compressing plate 14 is stopped and the bill is compressed and held between the members 13*a* and 13*b* and the bill compressing plate 14. The push plate 7 is restored to the original position by the force of the spring 21, leaving the clamped bill in the box 12. In this manner, a number of bills 22 are accumulated between the channel members 13*a* and 13*b* in the box 12 and the bill compressing plate 14.

By lifting a lid 24 mounted in the form of a latch as shown by reference character 24', the box 12 can be tilted as shown by reference character 12' about an unillustrated pivot and the accumulated bills can be readily taken out. It is also possible to exchange the box 12 by removing the tilted box 12 from the main body of the bill validator. An unillustrated safety switch is provided on the main body side in association with this box 12 for detecting that the box 12 has been tilted to the posture shown by 12' or has been removed from the main body thereby to stop driving of the motors M1 and M2 and prohibiting deposition of a bill during such tilting or removal of the box 12. During the accumulating operation of bills in the box 12 by the rotation of the motor M2, it is desirable to prohibit additional deposition of a bill. For this purpose, an arrangement is made so that, when the sensor S1 provided at the insertion slit 1 has detected a bill, rotation of the conveying motor M1 is prohibited (or the motor M1 is reversely rotated) for prohibiting deposition of a bill.

When the bill accumulating box 12 has become full with accumulated bills, further receiving of a bill is impossible so that insertion of an additional bill should be prohibited. For this purpose, some sort of fullness detection means should preferably be provided so that the rotation of the conveying motor M1 is stopped when the full state of the accumulation box has been detected or the motor M1 is reversely rotated to automatically return a deposited bill when the sensor S1 at the insertion slit 1 has detected the bill. As such fullness detection means, for example, a sensor may be provided at a suitable fullness detecting position in the box 12 or some means may be provided for detecting that the number of bills has reached a set maximum number by detecting that a load exceeding a predetermined value has been applied to the accumulating motor M2. For example, such application of a load exceeding a predetermined value to the motor M2 can be detected by detecting whether or not the carrier switch S3 has maintained the on state for more than a predetermined length of time. That is, when the accumulated number of bills has reached the maximum, the bill compressing plate 14 does not move in the direction of arrow A further and the rotation of the motor M2 is thereupon interrupted. In this case, the motor M2 may be reversely rotated to the standby state shown in FIG. 1.

Figure 5:
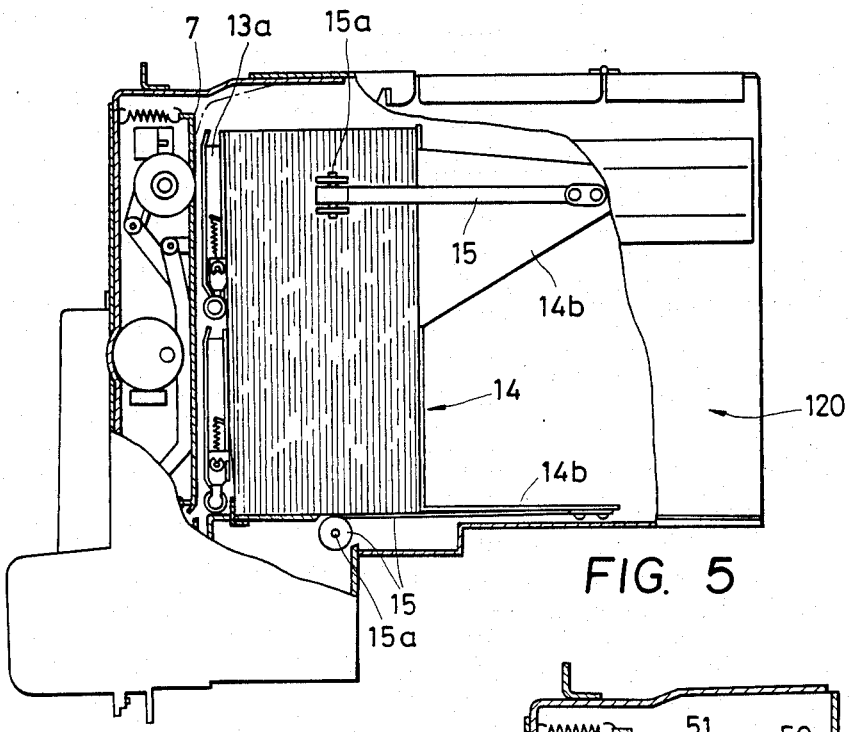
FIG. 5 is a vertical sectional view showing another embodiment of the invention.
Figure 6:
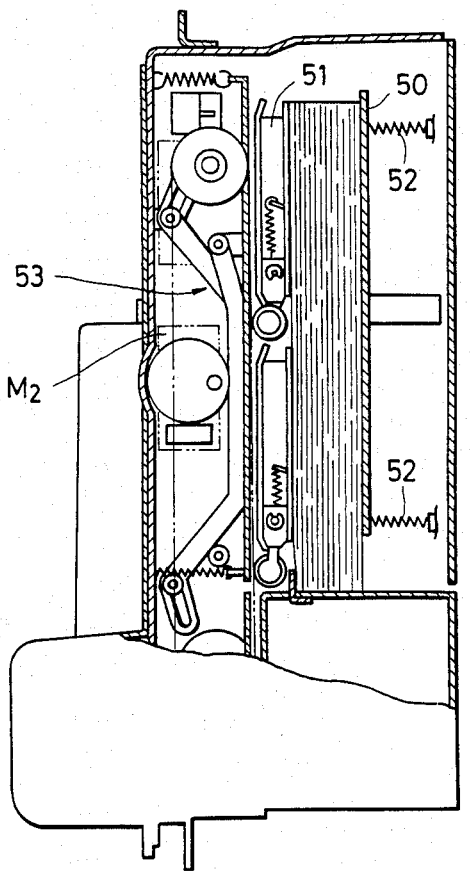
PRIOR ART FIG. 6
FIG. 6 is a vertical sectional view showing a prior art device.

FIG. 5 shows an example in which the mounting places of the winding shafts 15*a* of the constant springs 15 have been changed. In this example, the winding shafts 15*a* of the constant springs 15 are provided at locations which are relatively spaced from the channel members 13*a* and 13*b*. For enabling the bill compressing plate 14 to be pushed to a position in which it comes into contact with the channel members 13*a* and 13*b*, the connecting portions 14*b* provided on the left and right sides and the lower surface of the bill compressing plate 14 have a sufficient length for connecting the takeout ends of the springs 15. In other words, the distance between the surface of the bill compressing plate 14 and the spring takeout end connecting positions in the connecting portions 14*b* is equivalent to the distance between the spring winding shafts 15*a* and the channel members 13*a* and 13*b*.

The connecting portions 14*b* shown in FIG. 5 are longer than the connecting portions 14*a* shown in FIG. 1 and, in proportion thereto, the accumulating box 120 is a larger one than the accumulating box 12 shown in FIG. 1. In the above embodiments, there are provided four constant springs, i.e., two on the left and right sides and two on the lower surface. The number of the constant springs however is not limited to four but it may be two, three or five or more. It is not necessary for all of the constant springs 15 to support a bill by engaging with the periphery of the bill but only a part of the constant springs, e.g., the constant springs on the lower surface, may support the bill.

What is claimed is:

1. A bill validator comprising:

an accumulating box for accumulating bills;

bill conveying means for conveying bills to be accumulated to an entrance of said bill accumulating box;

reciprocating means disposed in the vicinity of said entrance of said accumulating box and comprising a push member for pushing a bill positioned at such entrance into said accumulating box and a mechanism for reciprocating said push member;

a pair of spaced parallel stationary members forming said entrance of said accumulating box, there being a space between said pair of spaced parallel stationary members which is somewhat narrower than the width of the bill;

a bill compressing plate, provided in said accumulating box, having breadth corresponding to the size of the bill and being movable in a translational motion in a normal direction to the surface of said plate; and constant springs defining a bill accumulating space in said accumulating box, said springs including winding shafts pivotably connected to said accumulating box, a first end fixedly secured to said bill compressing plate, a second end fixedly secured to said winding shaft, and an adjustable length portion extending between said winding shaft and said bill compressing plate one surface thereof defining a support surface, said constant springs urging said bill compressing plate to said entrance of said accumulating box with a constant compressing force, said constant springs being provided at least on the bottom portion of said accumulating box;

a plurality of bills being accumulated between said parallel stationary members of said entrance and said bill compressing plate in said accumulating box with the support surfaces of the constant springs engaging at least the bottom portions of the accumulated bills thereby support such bills.

2. A bill validator as defined in claim 1, wherein said constant springs are further provided on the left and right sides of said accumulating box.

* * * * *